US008509671B2

(12) United States Patent
Kimura et al.

(10) Patent No.: US 8,509,671 B2
(45) Date of Patent: Aug. 13, 2013

(54) CLEANER AND IMAGE FORMING APPARATUS

(75) Inventors: Akiko Kimura, Kanagawa (JP); Tomoya Ichikawa, Kanagawa (JP); Yuzo Ichikawa, Kanagawa (JP); Takahiro Shinkawa, Kanagawa (JP); Hirohisa Hoshino, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 13/103,648

(22) Filed: May 9, 2011

(65) Prior Publication Data

US 2012/0076559 A1 Mar. 29, 2012

(30) Foreign Application Priority Data

Sep. 24, 2010 (JP) ..... 2010-213379

(51) Int. Cl.
*G03G 21/00* (2006.01)

(52) U.S. Cl.
USPC ..... 399/351; 399/350

(58) Field of Classification Search
USPC ..... 399/350, 351
See application file for complete search history.

(56) References Cited

U.S. PATENT DOCUMENTS 7,711,308 B2 * 5/2010 Hozumi et al. ..... 399/351
8,306,470 B2 * 11/2012 Akamatsu et al. ..... 399/351

FOREIGN PATENT DOCUMENTS

JP 8-166751 A 6/1996
JP 2009-294355 A 12/2009

* cited by examiner

*Primary Examiner* — Hoang Ngo
(74) *Attorney, Agent, or Firm* — Sughrue Mion, PLLC

(57) ABSTRACT

A cleaner includes a cleaning member having a distal end in contact with an image carrier so as to remove developer attached to the image carrier, a cleaning container that stores the removed developer, a cleaning support body including a cleaning support portion extending from the distal end to a proximal end of the cleaning member so as to support the proximal end of the cleaning member, a bent portion bent from the cleaning support portion, and a supported portion supported by the cleaning container, a vibration-damping body in contact with an end of the bent portion opposite the cleaning support portion so as to regulate vibration of the cleaning support body, and a vibration-damping-body fixing member supported by the cleaning container and having a clamp portion that clamps the vibration-damping body between the vibration-damping-body fixing member and the end of the bent portion.

6 Claims, 9 Drawing Sheets

CLEANER AND IMAGE FORMING APPARATUS

CROSS-REFERENCE TO RELATED APPLICATIONS

This application is based on and claims priority under 35 USC 119 from Japanese Patent Application No. 2010-213379 filed Sep. 24, 2010.

BACKGROUND (i) Technical Field

The present invention relates to a cleaner and an image forming apparatus.

(ii) Related Art

Electrophotographic image forming apparatuses, such as copying machines and printers, of the related art include a cleaner that removes substances attached to a surface of an image carrier on which an image is transferred, for example, transfer residual toner, paper dust, and discharge products.

SUMMARY

According to an aspect of the present invention, there is provided a cleaner including: a plate-shaped cleaning member having a distal end in contact with an image carrier that carries an image on a surface, the cleaning member performing cleaning by removing developer attached to the surface of the image carrier; a cleaning container that stores the developer removed by the cleaning member; a cleaning support body including a cleaning support portion having a sheet-like shape extending in an extending direction from the distal end to a proximal end of the cleaning member, the cleaning support portion supporting the proximal end of the cleaning member, a bent portion extending in a direction bent from the extending direction of the cleaning support portion, and a supported portion provided in the cleaning support portion and supported by the cleaning container; a vibration-damping body provided in contact with an end of the bent portion opposite the cleaning support portion, the vibration-damping member regulating vibration of the cleaning support body; and a vibration-damping-body fixing member supported by the cleaning container, the vibration-damping-body fixing member having a clamp portion that clamps and supports the vibration-damping body between the vibration-damping-body fixing member and the end of the bent portion opposite the cleaning support portion.

BRIEF DESCRIPTION OF THE DRAWINGS

Exemplary embodiment(s) of the present invention will be described in detail based on the following figures, wherein:

FIG. 9A illustrates a case in which vibration occurs in a structure of the related art, FIG. 9B illustrates a case in which vibration occurs in a structure of the exemplary embodiment, and FIG. 9C illustrates a case in which a vibration-damping member is provided on a lower surface of a blade metal plate.

DETAILED DESCRIPTION

Figure 1:
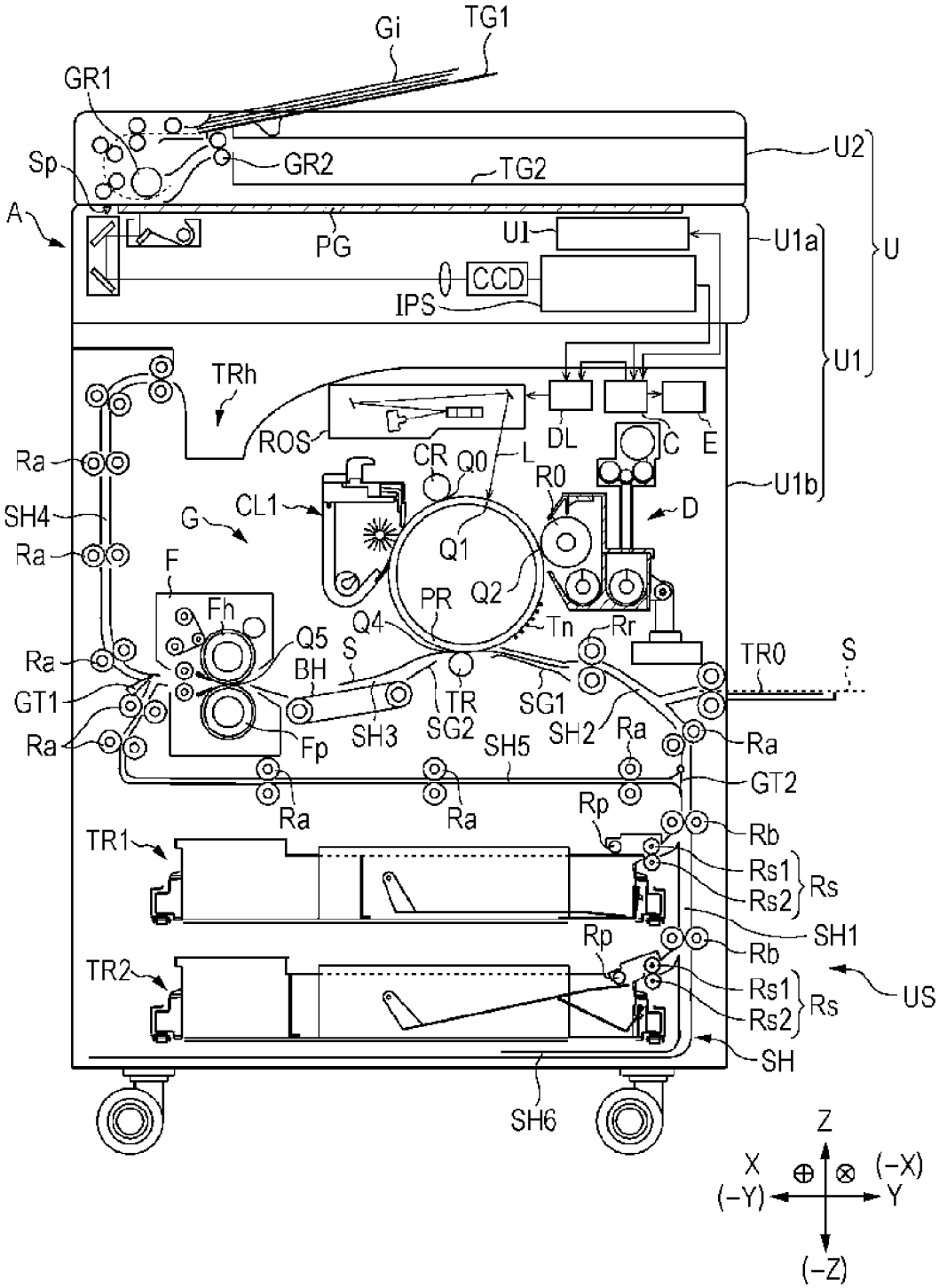
FIG. 1 is a cross-sectional view illustrating an overall configuration of an image forming apparatus according to an exemplary embodiment of the present invention.

While an exemplary embodiment of the present invention will now be described with reference to the drawings, the present invention is not limited to the following exemplary embodiment.

To easily understand the following description, in the drawings, the front-rear direction is designated as the X-axis direction, the right-left direction is designated as the Y-axis direction, and the up-down direction is designated as the Z-axis direction. The directions shown by arrows X, −X, Y, −Y, Z, and −Z are forward, rearward, rightward, leftward, upward, and downward directions or front, rear, right, left, upper, and lower sides.

Further, in the drawings, ⊕ indicates the arrow pointing from the back side to the front side of the paper of the drawing, and ⓧ indicates the arrow pointing from the front side to the back side of the paper plane.

In the following description using the drawings, illustrations of components other than components necessary for plain explanation are appropriately omitted.

Exemplary Embodiment

FIG. 1 is a cross-sectional view illustrating an overall configuration of an image forming apparatus U according to an exemplary embodiment of the present invention.

Referring to FIG. 1, the image forming apparatus U includes a digital copying machine body U1 serving as an example of an image forming apparatus that has a transparent document table, that is, a so-called platen glass PG on an upper surface thereof, and a document feeding device U2 supported on the platen glass PG.

The document feeding device U2 includes a document feed tray TG1 serving as an example of a document supply unit on which plural documents Gi to be copied are stacked. Plural documents G1 stacked on the document feed tray TG1 sequentially pass over a copying position on the platen glass PG, that is, a contact position where a platen roller GR1 serving as an example of a document feed member is in contact with the platen glass PG, and are output by document output members GR2 onto a document output tray TG2 serving as an example of a document output unit.

The copying machine body U1 includes a scanner unit U1*a* serving as an example of an image reading device provided with the above-described platen glass PG, and a printer unit U1*b* serving as an example of an image recording device.

The scanner unit U1*a* includes a position detection member for an exposure system provided at a reference reading position, that is, a so-called exposure-system registration sensor Sp, and an exposure optical system A.

The movement and stop of the exposure optical system A are controlled according to a detection signal from the exposure-system registration sensor Sp. Usually, the exposure optical system A stays at the reference reading position illustrated in FIG. 1.

In an automatic feeding operation in which copying is performed with the document feeding device U2, the exposure optical system A exposes documents Gi, which sequentially pass over the copying position on the platen glass PG, while staying at the reference reading position.

In contrast, in a manual reading operation in which a document Gi placed on the platen glass PG by the operator is copied, the exposure optical system A conducts exposure and scanning on the document Gi on the platen glass PG while moving to the right.

Reflected light from the exposed document Gi passes through the exposure optical system A, and is converged on an imaging unit CCD. The imaging unit CCD converts, into an electric signal, the light that is reflected from the document Gi and converged on an imaging surface thereof.

An image processing unit IPS converts a read image signal input from the imaging unit CCD into a digital image writing signal, and outputs the image writing signal to a writing driving circuit DL in the printer unit U1*b*.

The operation time of the writing driving circuit DL is controlled by a controller C provided in the printer unit U1*b*. The writing driving circuit DL outputs a driving signal in accordance with the input image data to a latent-image writing device ROS.

Below the latent-image writing device ROS, a photoconductor PR is provided as an example of a rotating image carrier. A surface of the photoconductor PR is charged in a charging area Q0 by a charging roller CR serving as an example of a charger, and is subjected to exposure and scanning with a laser beam L serving as an example of latent-image writing light from the latent-image writing device ROS at a latent-image writing position Q1, whereby an electrostatic latent image is formed on the surface of the photoconductor PR. After the electrostatic latent image is formed, the surface of the photoconductor PR rotates and sequentially passes through a developing area Q2 and a transfer area Q4.

The electrostatic latent image is developed by a developing device D in the developing area Q2. The developing device D transports developer to the developing area Q2 by means of a developing roller R0, and develops the electrostatic latent image on the surface of the photoconductor PR passing through the developing area Q2 to form a toner image Tn serving as an example of a visible image.

A transfer roller TR serving as an example of a transfer unit opposes the photoconductor PR in the transfer area Q4, and transfers the toner image Tn on the surface of the photoconductor PR onto a sheet S serving as an example of a medium. To the transfer roller TR, a transfer voltage of a polarity opposite the charging polarity of developing toner used in the developing device D is supplied from a power supply circuit E. The power supply circuit E supplies applied voltages such as a charging voltage to the charging roller CR, a developing voltage to the developing roller R0, and the transfer voltage to the transfer roller TR, and includes a heater power supply for heating a heater of a heating roller in a below-described fixing device F. The power supply circuit E is controlled by the controller C.

In a lower part of the copying machine body U1, a first sheet feed tray TR1 and a second sheet feed tray TR2 serving as sheet containers are arranged one above the other.

At an upper right end of each of the first and second sheet feed trays TR1 and TR2, a pickup roller Rp is provided as an example of a medium pickup member. A sheet S picked up by the pickup roller Rp is transported to a loosening member Rs.

The loosening member Rs includes a feed roller Rs1 serving as an example of a sheet feed member and a retard roller Rs2 serving as an example of a separation member. The feed roller Rs1 and the retard roller Rs2 are in contact with each other. Sheets transported to the loosening member Rs are separated one by one and transported into a sheet transport path SH1 serving as an example of a medium transport path.

In the sheet transport path SH1, transport rollers Rb are arranged as an example of a transport member capable of forward and reverse rotations. A sheet S in the sheet transport path SH1 is transported into an upper pre-transfer sheet transport path SH2 by the transport rollers Rb capable of forward and reverse rotations.

The sheet S in the pre-transfer sheet transport path SH2 is transported by transport rollers Ra to registration rollers Rr serving as an example of a member for adjusting the time of transport to the transfer area Q4.

A sheet S fed from a manual feed tray TR0 serving as an example of a manual feed unit is also transported to the registration rollers Rr.

The sheet S is transported from the registration rollers Rr to the transfer area Q4 along a pre-transfer sheet guide SG1 serving as an example of a pre-transfer medium guide member in synchronization with a time when the toner image Tn on the surface of the photoconductor PR moves to the transfer area Q4.

In the transfer area Q4, the toner image Tn developed on the surface of the photoconductor PR is transferred onto the sheet S by the transfer roller TR. After transfer, the surface of the photoconductor PR is cleaned by a cleaner CL1 serving as an example of a cleaner so as to remove residual toner serving as an example of an attached substance, and is charged again by the charging roller CR.

The photoconductor PR, the charging roller CR, the latent-image writing device ROS, the developing device D, etc. constitute a toner-image forming device G serving as a visible-image forming device. In the exemplary embodiment, the photoconductor PR and the cleaner CL1 are combined into an exchangeable image carrier unit, that is, a process cartridge PR+CL1, which can be integrally and detachably mounted in the image forming apparatus U.

Downstream of the transfer area Q4 in the sheet transport direction, a post-transfer sheet transport path SH3 is provided as an example of a transport path through which the sheet S having the toner image Tn transferred in the transfer area Q4 is transported to a fixing area Q5. After the toner image Tn is transferred on the sheet S by the transfer roller TR in the transfer area Q4, the sheet S is separated from the surface of the photoconductor PR, is guided by a post-transfer sheet guide SG2 serving as an example of a medium guide member provided in the post-transfer sheet transport path SH3, and is then transported to the fixing device F by a transport belt BH serving as an example of a post-transfer medium transport member.

The fixing device F includes a heating roller Fh serving as an example of a heating fixing member and a pressure roller Fp serving as an example of a pressurizing fixing member. The heating roller Fh incorporates a heater as a heat source. While the sheet S transported to the fixing device F passes through the fixing area Q5 formed by a contact area between the heating roller Fh and the pressure roller Fp, the toner image Tn is heated and fixed. Then, the sheet S is transported to a sheet output tray TRh serving as an example of a medium output unit through an output path SH4 serving as an example of a transport path.

In the sheet output path SH4 and downstream of the fixing device F, a switch gate GT1 is provided as an example of a member for switching the transport path. The switch gate GT1 switches the transport direction of the sheet S passing through the fixing device F to the sheet output tray TRh or a connecting path SH5. The connecting path SH5 connects an upstream end of the sheet output path SH4, that is, a downstream portion of the fixing device F to the sheet transport path SH1.

In the case of duplex copying, a sheet S having a toner image recorded on a first surface thereof is transported to the connecting path SH5 by the switch gate GT1, passes through a gate GT2 serving as an example of a transport-direction regulating member, and is transported into a reverse path SH6 serving as an example of a transport path by reverse rotation of the transport rollers Rb capable of forward and reverse rotations. The sheet S in the reverse path SH6 is transported in the reverse direction, that is, switched back by the forward rotation of the transport rollers Rb, and is transported upside down to the transfer area Q4 again while being upside down.

The elements SH1 to SH6 constitute a transport path SH serving as an example of a medium transport path.

The transport path SH and the rollers Ra, Rb, and Rr provided in the transport path SH and having a sheet transport function constitute a sheet transport device US serving as an example of a medium transport device.

Description of Cleaner

Figure 2:
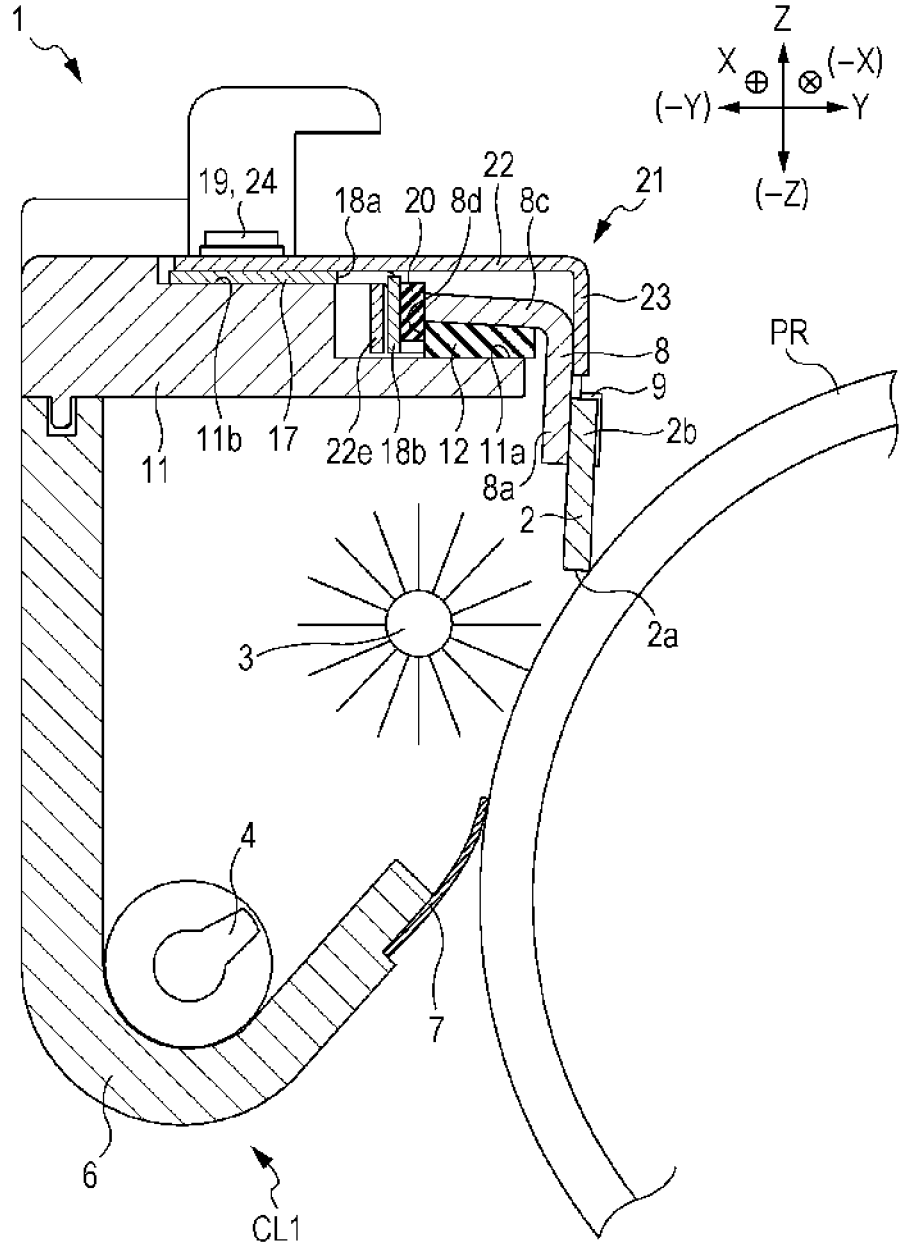
FIG. 2 is an enlarged view of the principal part of a cleaner in the exemplary embodiment.

FIG. 2 is an enlarged view of the principal part of the cleaner in the exemplary embodiment.

Figure 3:
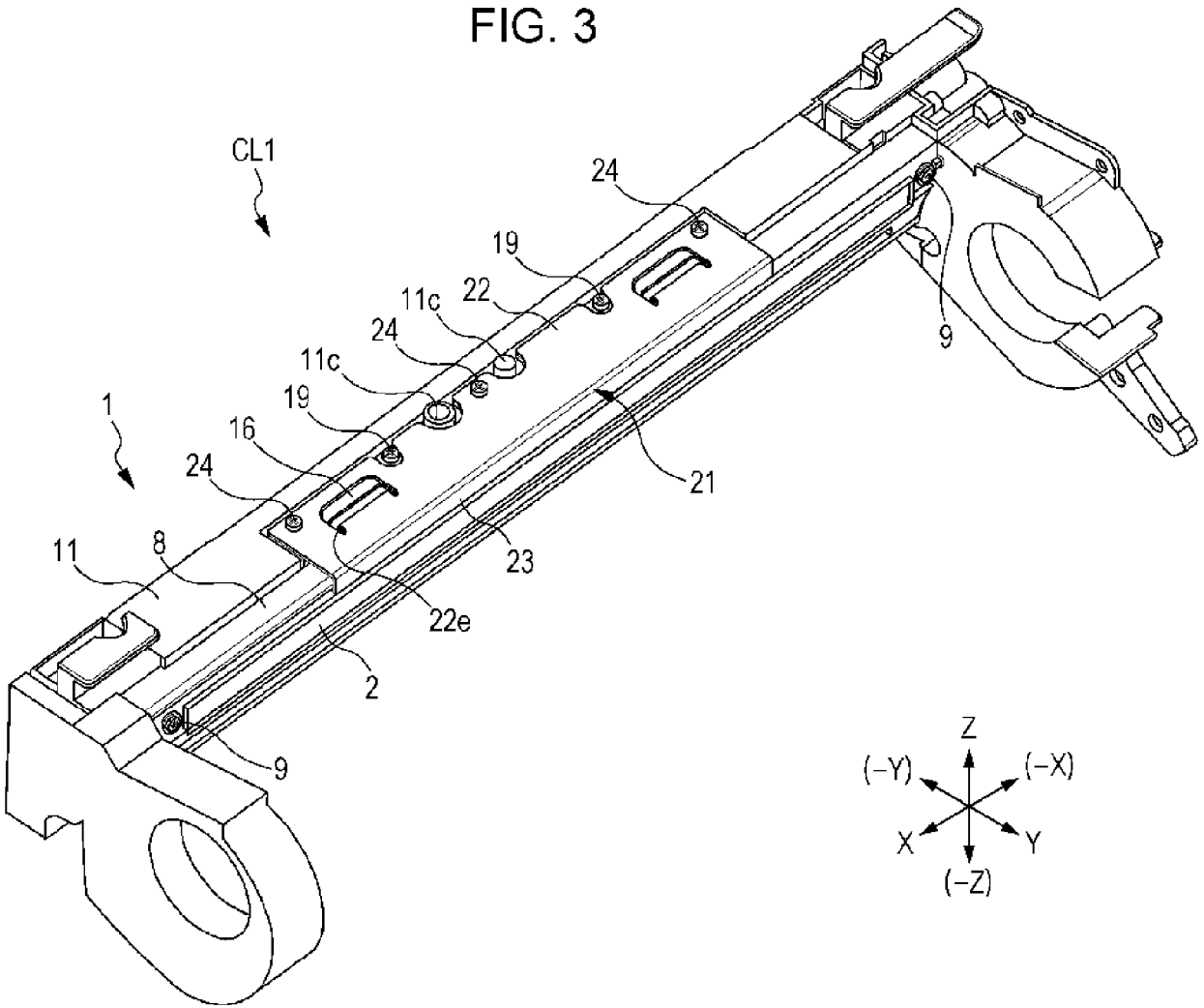
FIG. 3 is a perspective view illustrating a state in which an image carrier is removed from an image carrier unit in the exemplary embodiment.

FIG. 3 is a perspective view illustrating a state in which the image carrier is removed from the image carrier unit in the exemplary embodiment.

In FIGS. 1 to 3, the cleaner CL1 of the exemplary embodiment includes a cleaning container 1 serving as an example of a body of the cleaner. In the cleaning container 1, a plate-shaped cleaning blade 2 and a cleaning brush 3 are provided. The cleaning blade 2 serves as an example of a cleaning member, and removes residual toner on the surface of the photoconductor PR by a distal end 2*a* in contact with the surface of the photoconductor PR. The cleaning brush 3 serves as an example of a second cleaning member, and removes residual toner by contact with the surface of the photoconductor PR, and is provided on an upstream side of the cleaning blade 2 in the rotating direction of the photoconductor PR. The residual toner removed by the cleaning blade 2 and the cleaning brush 3 is recovered in the cleaning container 1. In the cleaning container 1, a transport member 4 is provided to transport the residual toner recovered in the cleaning container 1 toward a recovery container (not illustrated).

Referring to FIGS. 2 and 3, the cleaning container 1 includes a container body 6 extending in the front-rear direction along the photoconductor PR. In FIG. 2, a film seal 7 serving as an example of a leakage preventing member is fixed and supported at a lower part of a photoconductor PR side of the container body 6. The film seal 7 extends toward the surface of the photoconductor PR. An upper end of the film seal 7 is in contact with the surface of the photoconductor PR so as to prevent the residual toner from leaking out from the cleaning container 1.

In FIGS. 2 and 3, the cleaning blade 2 extends in the front-rear direction along the photoconductor PR on the photoconductor PR side of the container body 6. A proximal end 2*b* of the cleaning blade 2 is supported by a blade metal plate 8 serving as an example of a cleaning support body.

Figure 4:
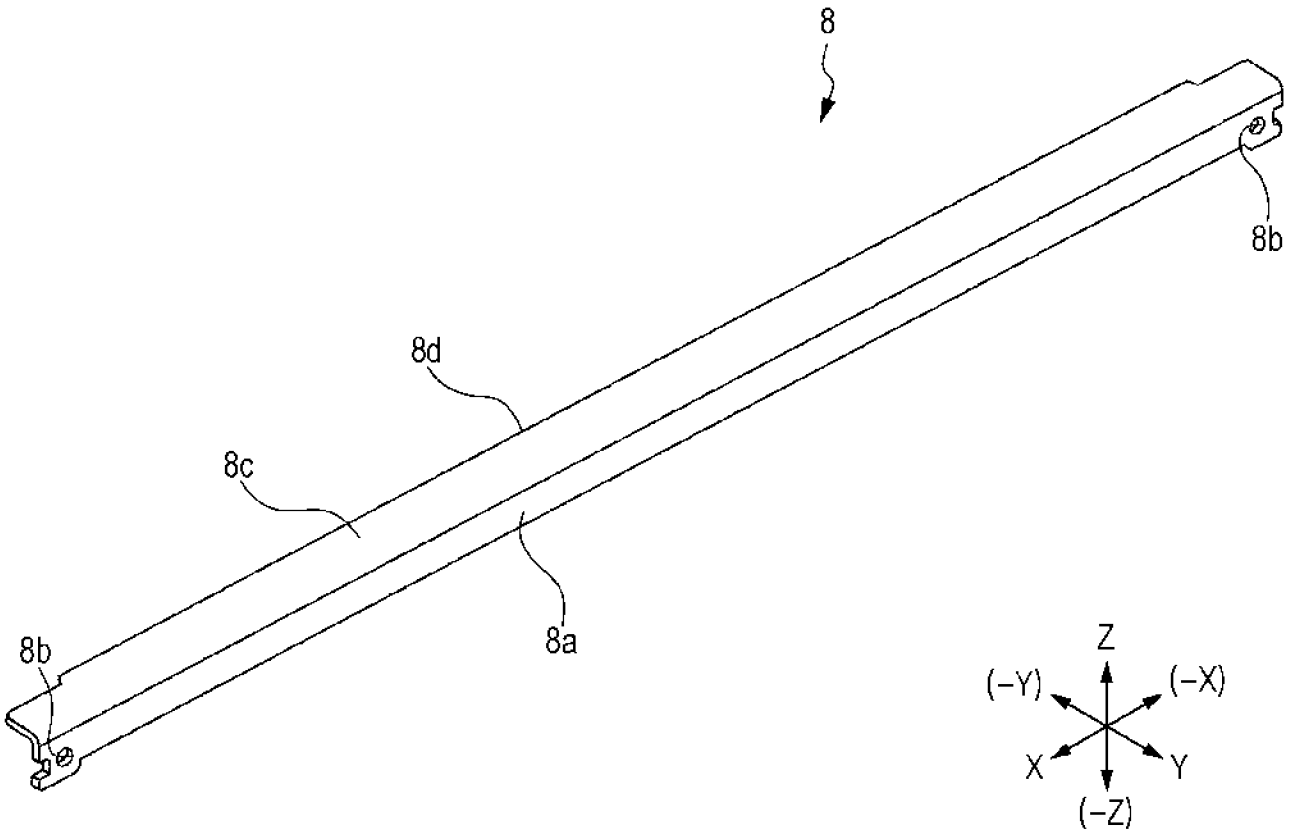
FIG. 4 is a perspective view of a cleaning support body in the exemplary embodiment.

FIG. 4 is a perspective view of the cleaning support body of the exemplary embodiment.

In FIGS. 2 to 4, the blade metal plate 8 of the exemplary embodiment is bent to have an L-shaped cross section. The blade metal plate 8 includes, as an example of a cleaning support portion, a blade support portion 8*a* shaped like a plate extending in the up-down direction from the distal end 2*a* to the proximal end 2*b* of the cleaning blade 2. The blade support portion 8*a* supports the proximal end 2*b* of the cleaning blade 2.

Both front and rear ends of the blade support portion 8*a* of the exemplary embodiment are provided with screw penetrating holes 8*b* serving as an example of a supported portion. Therefore, as illustrated in FIG. 3, the blade metal plate 8 is supported on the container body 6 by screws 9 that serve as an example of a fixing member and penetrate the screw penetrating holes 8*b*. Hence, the cleaning blade 2 is fixed by the fixing of the blade metal plate 8 with the screws 9, so that the contact pressure with the photoconductor PR is set to be a predetermined pressure.

The blade metal plate 8 also includes a bent portion 8*c* bent in the leftward direction from the up-down direction in which the blade support portion 8*a* extends. At a left end of the bent portion 8*c*, a rubber support face 8*d* is provided as an example of a first clamp portion for a vibration-damping body.

Figure 5:
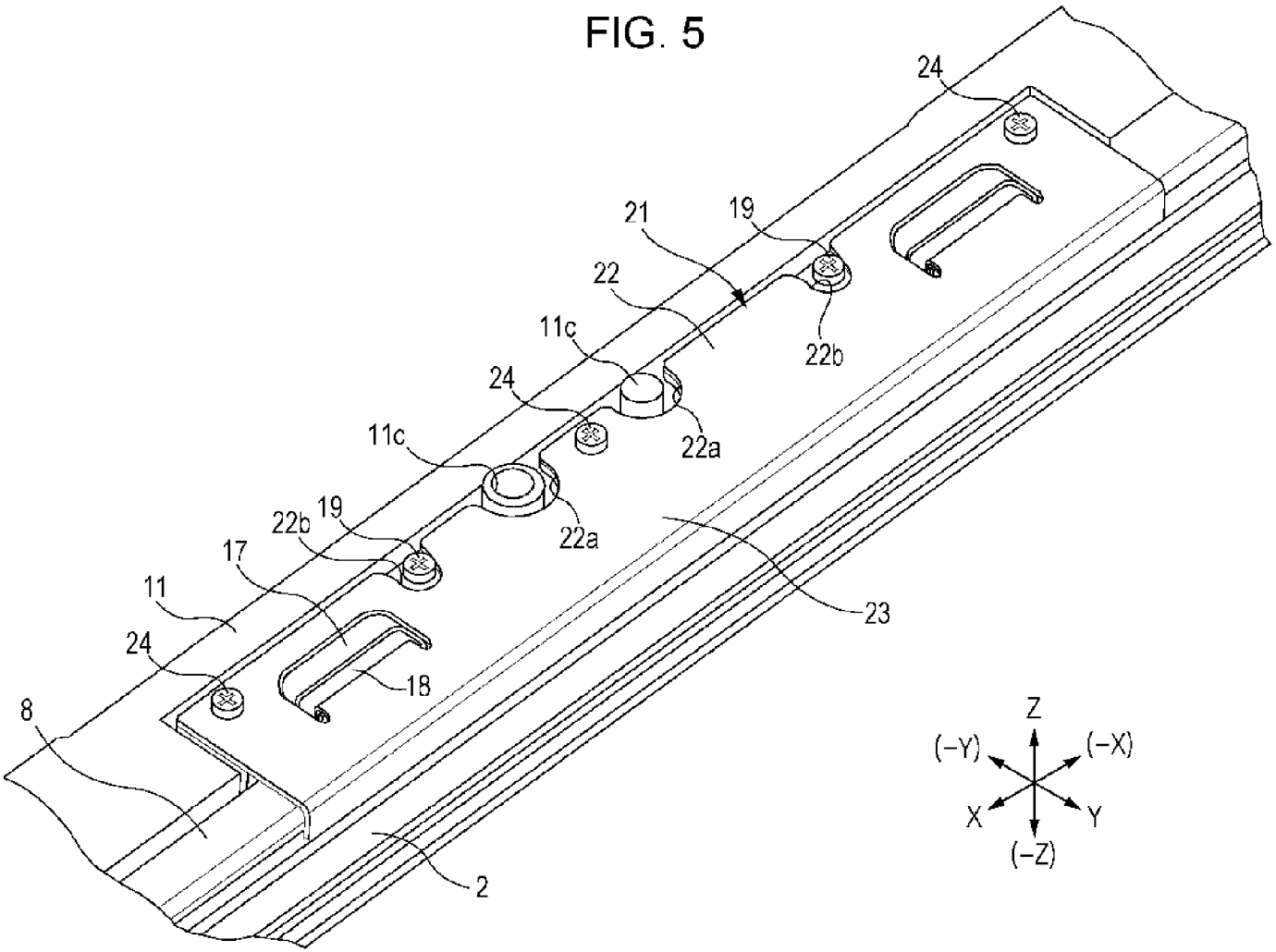
FIG. 5 is an enlarged view of a fixing member in FIG. 3.

FIG. 5 is an enlarged view of the fixing member of FIG. 3.

Figure 6:
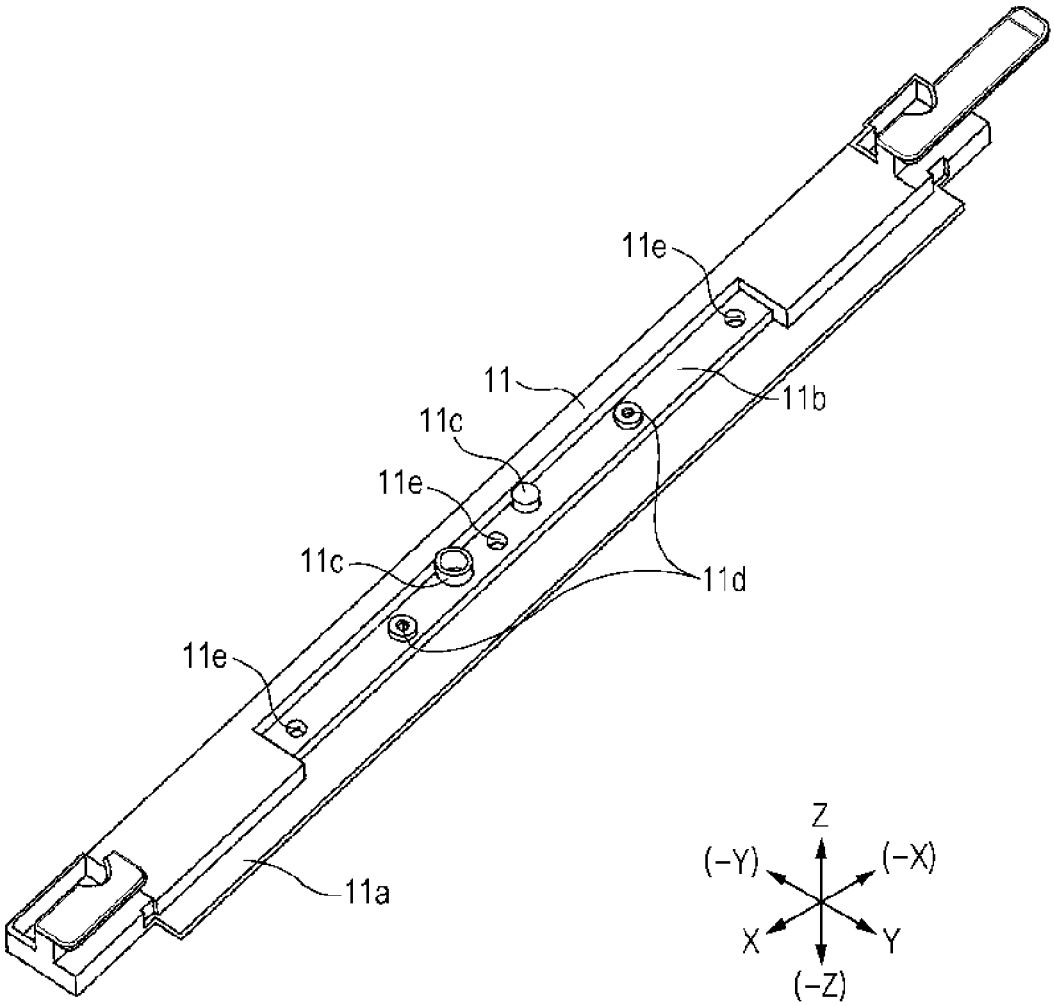
FIG. 6 is a perspective view of a support body of the fixing member in the exemplary embodiment.

FIG. 6 is a perspective view of a support body of the fixing member of the exemplary embodiment.

Referring to FIG. 2, a holder flicker 11 serving as an example of a support body of the fixing member is supported at an upper end of the container body 6. In FIGS. 3, 5, and 6, the holder flicker 11 of the exemplary embodiment is shaped like a plate extending in the front-rear direction. At a right end of the holder flicker 11, a seal support face 11*a* extending in the front-rear direction is provided as an example of a support portion for a sealing member. In FIG. 2, a urethane seal 12 serving as an example of a sealing member is attached on an upper surface of the seal support face 11*a*. The urethane seal 12 closes the gap between the seal support face 11*a* and a lower surface of the bent portion 8*c* of the blade metal plate 8. Therefore, the urethane seal 12 closes the gap between the holder flicker 11 and the blade metal plate 8, whereby leakage of the developer from the cleaning container 1 is prevented.

Referring to FIG. 6, a plate fixing portion 11*b* serving as an example of a support portion of the fixing member is provided in the center of the holder flicker 11 in the front-rear direction. The plate fixing portion 11*b* has a pair of positioning projections 11*c* serving as positioning portions. The positioning projections 11*c* project upward from the center of the plate fixing portion 11*b* in the front-rear direction. A pair of front and rear screw holes 11*d* serving as an example of a fixing portion are respectively provided on front and rear sides of the positioning projections 11*c* in the front-rear direction. Further, downward concave portions 11*e* serving as an example of a receiving portion are provided at three positions, that is, on front and rear sides of the screw holes 11*d* and between the positioning projections 11*c*.

Figure 7:
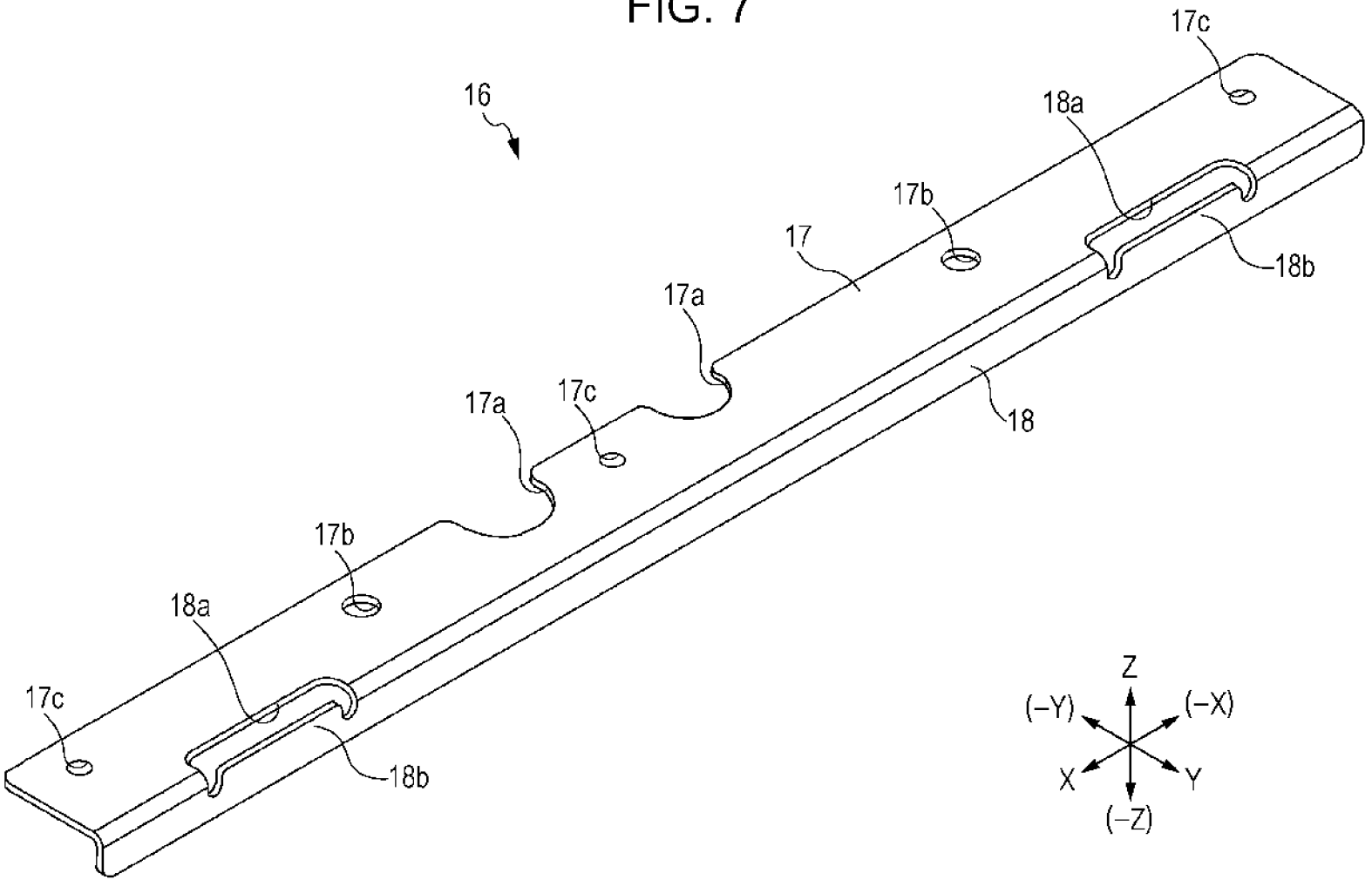
FIG. 7 is a perspective view of a first fixing member in the exemplary embodiment.

FIG. 7 is a perspective view of a first fixing member of the exemplary embodiment.

In FIGS. 2, 3, 5, and 7, a rubber fixing member 16 serving as an example of a first fixing member extends in the front-rear direction, and is supported on the plate fixing portion 11*b* of the holder flicker 11. The rubber fixing member 16 includes a fixed plate 17 serving as an example of a fixed portion extending along the plate fixing portion 11*b*, and a rubber fixing plate 18 serving as an example of a vibration-damping fixing portion bent downward from a right end of the fixed plate 17.

The fixed plate 17 has a pair of front and rear semicircular cutouts 17*a* provided at positions corresponding to the positioning projections 11*c* of the plate fixing portion 11*b* in a manner such that the positioning projections 11*c* are received in the cutouts 17*a*. Therefore, if the rubber fixing member 16 is improperly mounted on the plate fixing portion 11*b*, the positioning projections 11*c* interfere with the mounting. When the rubber fixing member 16 is properly mounted, the positioning projections 11*c* are received in the cutouts 17*a*.

The fixed plate 17 also has screw penetrating holes 17*b* that serve as an example of a fixed portion and are provided at positions corresponding to the two screw holes 11*d*. As illustrated in FIG. 5, the fixed plate 17 is fixed and supported on the plate fixing portion 11*b* of the holder flicker 11 by screws 19 that serve as an example of a fixing member and penetrate the screw penetrating holes 17*b* to be fastened into the screw holes 11*d*.

In addition, three screw holes 17*c* serving as an example of a fixing portion are provided at positions corresponding to the three concave portions 11*e*.

Apertures 18*a* are provided through the fixed plate 17 and the rubber fixing plate 18 at front and rear ends of a boundary between the plates 17 and 18. Plate-shaped rubber fixing portions 18*b* serving as an example of a second clamp portion for the vibration-damping body extend upward from lower edges of the apertures 18*a*.

Referring to FIG. 2, vibration-damping rubbers 20 serving as an example of a vibration-damping body are supported between the rubber fixing portions 18*b* and the rubber support face 8*d* of the blade metal plate 8. The vibration-damping rubbers 20 are formed, for example, of an elastically deformable material. In the exemplary embodiment, the vibration-damping rubbers 20 are provided at two positions, that is, front and rear positions corresponding to the rubber fixing portions 18*b*. Also, the vibration-damping rubbers 20 are supported while being bonded to the rubber fixing portions 18*b* with double-sided adhesive tapes serving as an example of a fixing member.

Figure 8:
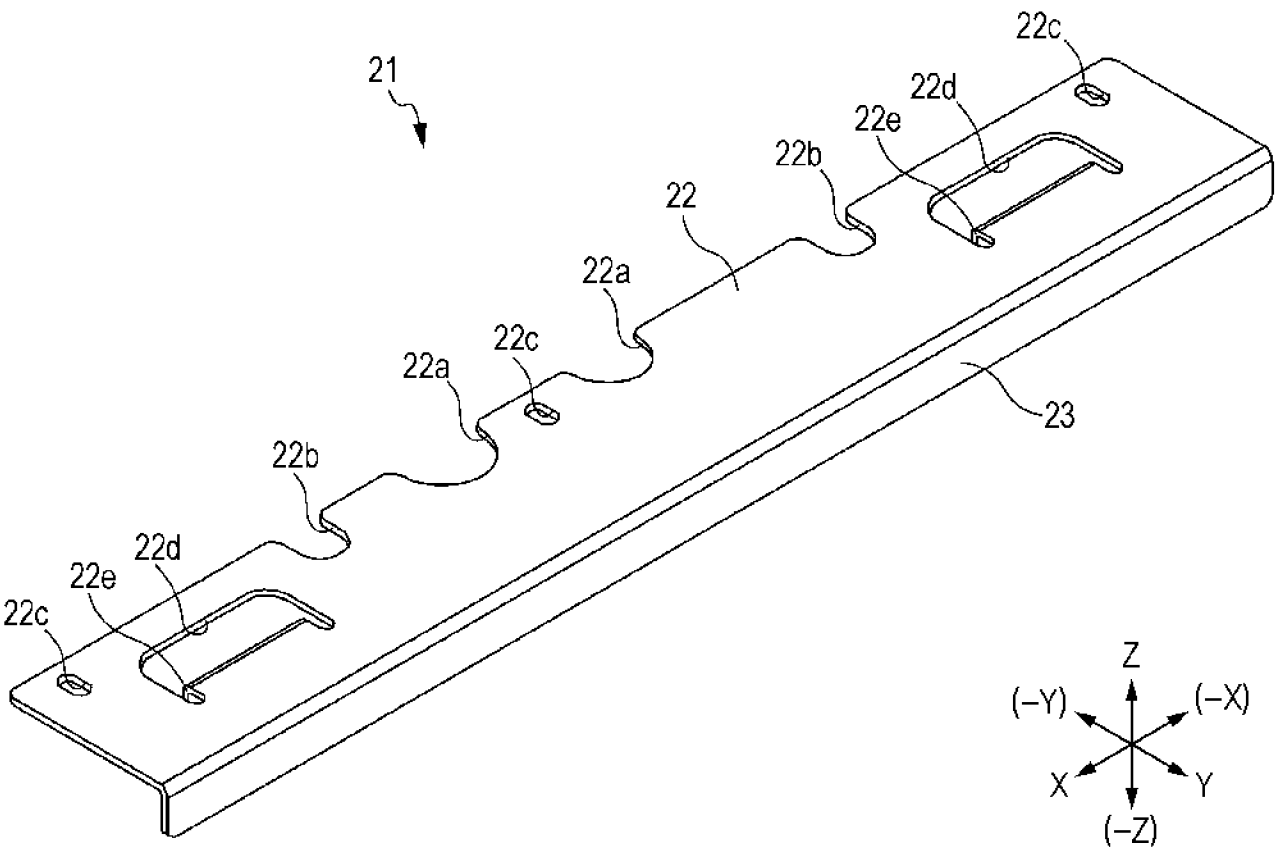
FIG. 8 is a perspective view of a second fixing member in the exemplary embodiment.

FIG. 8 is a perspective view of a second fixing member of the exemplary embodiment.

Referring to FIGS. 2, 3, 5, and 8, a regulation plate 21 extending in the front-rear direction is provided as an example of a second fixing member on the rubber fixing member 16.

The regulation plate 21 includes an upper plate 22 facing the fixed plate 17, and a vertical plate 23 bent downward from a right end of the upper plate 22.

In FIGS. 5 and 8, the upper plate 22 has semicircular second cutouts 22*a* provided corresponding to the positioning projections 11*c*, similarly to the cutouts 17*a*. Further, semicircularly cut screw avoiding portions 22*b* are respectively provided on front and rear sides of the second cutouts 22*a* and at positions corresponding to the screws 19.

Further, the upper plate 22 has three screw slots 22*c* serving as an example of a fixed portion. The screw slots 22*c* extend in the right-rear direction at positions corresponding to the three screw holes 17*c*.

Referring to FIGS. 4 and 5, the regulation plate 21 is fixed and supported on the fixed plate 17 by screws 24 that serve as an example of a fixing member and penetrate the screw slots 22*c* to be fastened in the screw holes 17*c*. Tips of the screws 24 penetrating the screw holes 17*c* are received in the concave portions 11*e* of the holder flicker 11.

Second apertures 22*d* are respectively provided through front and rear ends of the upper plate 22 and extend in the up-down direction at positions corresponding to the apertures 18*a* of the rubber fixing member 16. Holding portions 22*e* bent downward from right edges of the second apertures 22 are provided at positions opposing and adjoining left sides of the rubber fixing portions 18*b*, as illustrated in FIG. 2.

In FIG. 2, a holding face 23*a* serving as an example of a regulating portion is provided on an inner side of the vertical plate 23 of the exemplary embodiment. The holding face 23*a* holds the blade support portion 8*a* of the blade metal plate 8 by contact therewith.

The rubber fixing member 16 and the regulation plate 21 constitute a vibration-damping fixing member 16+21 serving as an example of a vibration-damping-body fixing member.

Operation of Exemplary Embodiment

In the image forming apparatus U of the exemplary embodiment having the above-described configuration, after an image formed on the surface of the photoconductor PR is transferred on a sheet S, residues remaining on the surface of the photoconductor PR are removed by the cleaning brush 3 and the cleaning blade 2. The contact pressure of the plate-shaped cleaning blade 2 in contact with the photoconductor PR changes according to the number and distribution of residues remaining on the surface of the photoconductor PR, unevenness of the surface of the photoconductor PR, and eccentricity of the photoconductor PR. Therefore, vibration sometimes occurs in the cleaning blade 2 because the distal end 2*a* of the cleaning blade 2 receives a deforming force in a direction to turn along the surface of the photoconductor PR and a direction to expand and contract. If vibration occurs in the cleaning blade 2, the blade metal plate 8 on which the cleaning blade 2 is supported sometimes vibrates and causes noise.

In contrast, in the cleaner CL1 of the exemplary embodiment, the vibration-damping rubbers 20 between the blade metal plate 8 and the rubber fixing member 16 absorb and damp vibration, and thereby reduce noise.

Figure 9A:
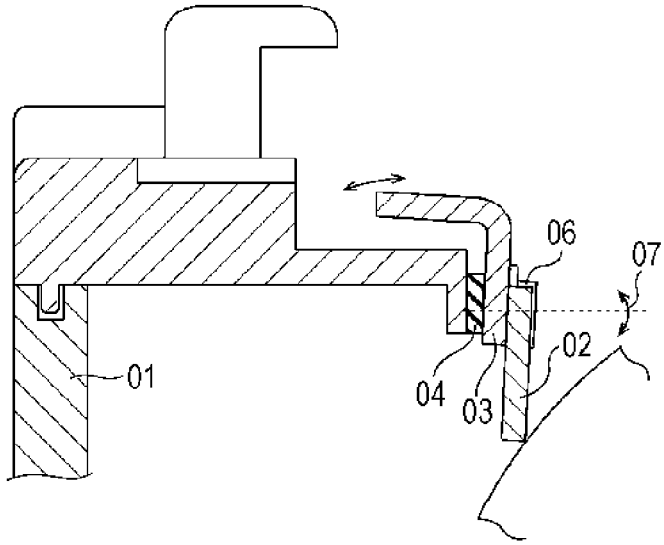
FIGS. 9A to 9C illustrate the operation of the exemplary embodiment.
Figure 9B:
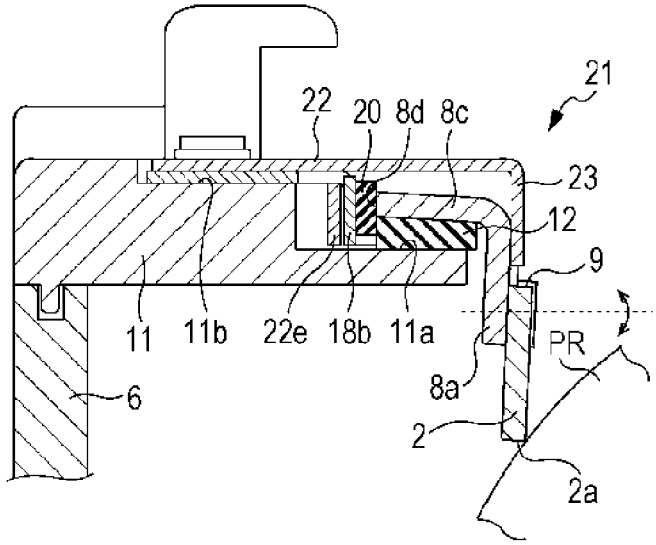
Figure 9C:
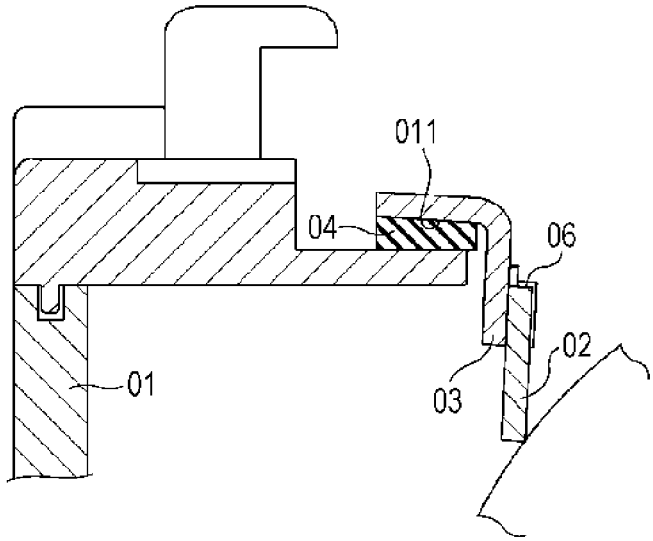

FIGS. 9A to 9C are operation diagrams of the exemplary embodiment. FIG. 9A illustrates a case in which vibration occurs in the structure of the related art, FIG. 9B illustrates a case in which vibration occurs in the structure of the exemplary embodiment, and FIG. 9C illustrates a case in which a vibration-damping member is located on a lower surface of a blade metal plate.

In the structure of the related art illustrated in FIG. 9A, a vibration-damping member 04 is inserted between a container 01 and a metal plate 03 for supporting a cleaning blade 02, and the cleaning blade 02 is fixed to the container 01 with a screw 06 near the vibration-damping member 04. Therefore, when the metal plate 03 is vibrated by vibration of the cleaning blade 02, a vibration in a direction of arrow 07 occurs around the screw 06. In this case, the vibration-damping member 04 is located near the center of vibration, and the amplitude of vibration is low at the vibration-damping member 04, so that the amount of elastic deformation of the vibration-damping member 04 is small. Hence, the amount of vibration absorbed and damped by the vibration-damping member 04 is small, and vibration does not easily decrease and damp.

In contrast, in the structure of the exemplary embodiment illustrated in FIG. 9B, the vibration-damping rubbers 20 are located farthest from the screws 9. Therefore, at the rubber support face 8*d* corresponding to the vibration-damping rubbers 20, the amplitude of vibration is high, and the amount of elastic deformation of the vibration-damping rubbers 20, that is, the absorption amount of vibration is large. Thus, the vibration may be more efficiently damped than in the structure of FIG. 9A.

In particular, in the structure of the exemplary embodiment, the vibration-damping rubbers 20 are located on the rubber support face 8*d* at the left end in the right-left direction in which the bent portion 8*c* extends, not on the upper or lower surface intersecting the right-left direction. For example, if the vibration-damping member 04 is located on a lower surface 011, as illustrated in FIG. 9C, when the vibration-damping member 04 absorbs vibration, the metal plate 03 itself is bent by reaction force from the vibration-damping member 04 and absorbs part of the vibration. Hence, the L-shaped metal plate 03 remains bent and elastically deformed, and vibration may occur when the metal plate 03 returns to an unbent state. In contrast, when the vibration-damping rubbers 20 are provided at the end of the bent portion 8*c*, as in the exemplary embodiment, the bend is less likely to remain in the blade metal plate 8 than in the case of FIG. 9C. This efficiently damps the vibration and reduces noise.

In the cleaner CL1 of the exemplary embodiment, the vibration-damping rubbers 20 are supported while being clamped between the rubber fixing portions 18*b* and the rubber support face 8*d*, and the elastic restoring force of the vibration-damping rubbers 20 acts in a normal state in which no vibration occurs. Therefore, the rubber fixing portions 18*b* are pushed by the vibration-damping rubbers 20 and receive a force such as to be bent to the left. Hence, the rubber fixing portions 18*b* may permanently deform with time, and reduce the ability of the vibration-damping rubbers 20 to damp the vibration. Accordingly, in the exemplary embodiment, the holding portions 22*e* are provided on sides of the vibration-damping rubbers 20 opposite the rubber fixing portions 18*b*. Hence, even if the rubber fixing portions 18*b* are pushed by the vibration-damping rubbers 20, the holding portions 22*e* hold the rubber fixing portions 18*b* by contact therewith, and suppress bending, a warp, and deformation of the rubber fixing portions 18*b*. Therefore, the decrease with time in the ability of the vibration-damping rubbers 20 to damp vibration is smaller than in the case in which the holding portions 22*e* are not provided.

Further, in the exemplary embodiment, the regulation plate 21 provided with the holding portions 22*e* has the holding face 23*a* that holds the blade metal plate 8. Therefore, vibration of the blade metal plate 8 is restricted not only by the vibration-damping rubbers 20 at the left end, but also by the holding face 23*a* on the right side. Thus, vibration is more efficiently damped than in the case in which the holding face 23*a* is not provided.

Moreover, the regulation plate 21 has the holding face 23*a* and the holding portions 22*e*, and the blade metal plate 8 and the rubber fixing portions 18*b* are clamped from the outer side by the regulation plate 21 formed as a single member. Therefore, the size after deformation of the vibration-damping rubbers 20 clamped between the blade metal plate 8 and the rubber fixing portions 18*b* is controlled and managed according to the manufacturing accuracy of the regulation plate 21.

In addition, in the exemplary embodiment, the vibration-damping fixing member 16+21 is not an integral member, but includes two members, namely, the rubber fixing member 16 and the regulation plate 21 that are connected by the screws 24. If the vibration-damping fixing member 16+21 is formed as an integral member and is provided with the apertures 18*a* and the cutouts 17*a*, the total rigidity and strength is prone to be low. In contrast, in the exemplary embodiment, the vibration-damping fixing member 16+21 is formed by two members, namely, the rubber fixing member 16 and the regulation plate 21. Thus, high rigidity may be more easily ensured in the connected structure than in the single member.

If the vibration-damping fixing member is integrally formed, it needs to be assembled in the cleaning container 1 while being clamped at both sides between the rubber fixing portions 18*b* and the holding face 23*a*. In contrast, in the structure of the exemplary embodiment, the rubber fixing member 16 is fixed to clamp the vibration-damping rubbers 20, and the regulation plate 21 is then fixed such that the holding face 23*a* holds the blade metal plate 8. This allows a relatively easy assembly.

Modifications

While the exemplary embodiment of the present invention has been described in detail above, the invention is not limited to the exemplary embodiment. Various modifications may be made within the scope of the invention defined by the claims. The followings are modifications H01 to H06 of the invention.

(H01) While the copying machine U is given as an example of an image forming apparatus in the above-described exemplary embodiment, for example, the image forming apparatus may be formed by a printer, a facsimile machine, or a multifunction apparatus having some or all of these functions.

(H02) While the image forming apparatus U uses monochromatic developer in the exemplary embodiment, the invention is also applicable to a multicolor image forming apparatus.

(H03) While the holding portions 22*e* preferably hold the back sides of the rubber fixing portions 18*b* in the exemplary embodiment, they may be omitted. Further, while the holding portions 22*e* are formed by cutting and bending parts of the regulation plate 21, they may be formed in an arbitrary shape and by an arbitrary forming method. For example, only the holding portions 22*e* may be formed separately from the regulation plate 21, and may be connected by screws or adhesive. The shape of the holding portions 22*e* is not limited to the plate shape, but may have an arbitrary shape, for example, may have a U-shaped or H-shaped cross section.

(H04) While it is preferable in the exemplary embodiment that the holding face 23*a* of the vertical plate 23 holds the blade metal plate 8, the vertical plate 23 and the holding face 23*a* may be omitted. Further, the shape and forming method of the vertical plate 23 may also be changed, similarly to the holding portions 22*e* described in the above (H03). For example, the vertical plate 23 may be formed as a separate member.

(H05) While the vibration-damping fixing member 16+21 is formed by two members, namely, the rubber fixing member 16 and the regulation plate 21 in the above exemplary embodiment, alternatively, it may be integrally formed or formed by three or more members.

(H06) While two vibration-damping rubbers 20 are provided in the above exemplary embodiment, the number, length, and size of the vibration-damping rubbers 20 may be changed according to the design and specifications. When the length and number of the vibration-damping rubbers 20 in the front-rear direction are increased, the total force of the vibration-damping rubbers 20 for pushing the rubber fixing portions 18*b* also increases, and bending easily occurs. Hence, the number and size of the vibration-damping rubbers 20 are preferably set such that bending of the rubber fixing member 16 and the blade metal plate 8 may be controlled, that is, such that the bending of the cleaning blade 2 does not adversely affect the cleaning ability.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaner comprising:

a substantially plate-shaped cleaning member having a distal end in contact with an image carrier that carries an image on a surface, the cleaning member performing cleaning by removing developer attached to the surface of the image carrier;

a cleaning container that stores the developer removed by the cleaning member;

a cleaning support body including a cleaning support portion having a substantially sheet-like shape extending in an extending direction from the distal end to a proximal end of the cleaning member, the cleaning support portion supporting the proximal end of the cleaning member, a bent portion extending in a direction bent from the extending direction of the cleaning support portion, and a supported portion provided in the cleaning support portion and supported by the cleaning container;

a vibration-damping body provided in contact with an end of the bent portion opposite the cleaning support portion, the vibration-damping member regulating vibration of the cleaning support body; and a vibration-damping-body fixing member supported by the cleaning container, the vibration-damping-body fixing member having a clamp portion that clamps and supports the vibration-damping body between the vibration-damping-body fixing member and the end of the bent portion opposite the cleaning support portion.

2. The cleaner according to claim 1, wherein the vibration-damping-body fixing member includes a regulating portion that regulates the vibration of the cleaning support portion by contact with the cleaning support portion.

3. The cleaner according to claim 2, wherein the vibration-damping-body fixing member includes a first fixing member having the clamp portion and a second fixing member having the regulating portion.

4. An image forming apparatus comprising:

an image carrier that carries an image on a surface;

a developing device that develops a latent image on the surface of the image carrier to form a visible image;

a transfer unit that transfers the visible image developed by the developing device onto a medium;

a cleaner that performs cleaning by removing developer attached to the surface of the image carrier after the visible image is transferred; and a fixing device that fixes the visible image transferred on the medium, wherein the cleaner includes a substantially plate-shaped cleaning member having a distal end in contact with the image carrier, the cleaning member performing cleaning by removing the developer attached to the surface of the image carrier, a cleaning container that stores the developer removed by the cleaning member, a cleaning support body including a cleaning support portion having a substantially sheet-like shape extending in an extending direction from the distal end to a proximal end of the cleaning member, the cleaning support portion supporting the proximal end of the cleaning member, a bent portion extending in a direction bent from the extending direction of the cleaning support portion, and a supported portion provided in the cleaning support portion and supported by the cleaning container, a vibration-damping body provided in contact with an end of the bent portion opposite the cleaning support portion, the vibration-damping member regulating vibration of the cleaning support body, and a vibration-damping-body fixing member supported by the cleaning container, the vibration-damping-body fixing member having a clamp portion that clamps and supports the vibration-damping body between the vibration-damping-body fixing member and the end of the bent portion opposite the cleaning support portion.

5. The image forming apparatus according to claim 4, wherein the vibration-damping-body fixing member includes a regulating portion that regulates the vibration of the cleaning support portion by contact with the cleaning support portion.

6. The image forming apparatus according to claim 5, wherein the vibration-damping-body fixing member includes a first fixing member having the clamp portion and a second fixing member having the regulating portion.

* * * * *